US006318600B1

(12) United States Patent
Winnett et al.

(10) Patent No.: US 6,318,600 B1
(45) Date of Patent: Nov. 20, 2001

(54) DISPENSER FOR DISPENSING SHAVING CREAM OR OTHER AEROSOL DISPENSED PRODUCTS FROM CANS HAVING DIFFERENT HEIGHTS AND DIAMETERS

(76) Inventors: Harold G. Winnett, 19651 Greenbriar Dr., Tarzana, CA (US) 91356; Bernard Ilan Urfig, 11777 San Vicente Blvd., No. 777, Los Angeles, CA (US) 90049

( * ) Notice: Subject to any disclaimer, the term of this patent is extended or adjusted under 35 U.S.C. 154(b) by 0 days.

(21) Appl. No.: 09/495,973

(22) Filed: Feb. 2, 2000

(51) Int. Cl.[7] ..... B67D 5/64

(52) U.S. Cl. ..... 222/173; 222/174; 222/181.2; 222/181.3; 222/402.1; 222/402.15

(58) Field of Search ..... 222/402.15, 402.13, 222/402.1, 181.2, 181.3, 509, 518, 174, 173

(56) References Cited

U.S. PATENT DOCUMENTS

| | | | | |
|---|---|---|---|---|
| 1,896,750 | * | 2/1933 | Maas | 222/181.2 |
| 2,948,308 | | 8/1960 | Regina . | |
| 2,967,643 | * | 1/1961 | Edelstein et al. | 222/70 |
| 3,032,081 | | 5/1962 | La Cotta . | |
| 3,045,878 | * | 7/1962 | Blanford et al. | 222/473 |
| 3,100,065 | * | 8/1963 | Gross | 222/180 |
| 3,220,613 | | 11/1965 | Palmer et al. . | |
| 4,111,338 | | 9/1978 | Cheng et al. . | |
| 4,171,776 | * | 10/1979 | Pagliaro | 239/274 |
| 4,264,038 | * | 4/1981 | Nozawa | 239/333 |
| 4,428,512 | * | 1/1984 | Nosek | 222/402.15 |
| 4,789,083 | | 12/1988 | Gutierrez . | |
| 4,838,456 | * | 6/1989 | Hamlin | 222/1 |
| 5,518,051 | | 5/1996 | Wells . | |

* cited by examiner

*Primary Examiner*—Kevin Shaver
*Assistant Examiner*—Frederick Nicolas
(74) *Attorney, Agent, or Firm*—Thomas I. Rozsa; Tony D. Chen; Jerry Fong

(57) ABSTRACT

A dispenser for dispensing shaving cream or other aerosol dispensed products from cans having different heights and diameters. The device can be easily mounted on a wall or retained on a counter for easy dispensing of the can's contents through the use of only one finger. The device provides a simple mechanical dispensing member which can accommodate cans of a given diameter and different heights and can also accommodate cans having a shorter height and wider diameter, and which is configured so that each specific can is brought into alignment so that its dispensing nozzle is aligned with the dispensing peg on the transverse handle.

29 Claims, 3 Drawing Sheets

DISPENSER FOR DISPENSING SHAVING CREAM OR OTHER AEROSOL DISPENSED PRODUCTS FROM CANS HAVING DIFFERENT HEIGHTS AND DIAMETERS

BACKGROUND OF THE INVENTION

1. Field of the Invention

The present invention generally relates to the field of dispensers for dispensing the contents from cans having an aerosol spray nozzle. More particularly, the present invention relates to the field of dispensers for dispensing shaving cream or other aerosol dispensed products from cans having different heights and diameters.

2. Description of the Prior Art

In general, devices for dispensing the contents from cans having an aerosol spray nozzle are known in the prior art.

The following seven (7) prior art patents are found to be pertinent to the field of the present invention:

1. U. S. Pat. No. 2,948,308 issued to Regina on Aug. 9, 1960 for "Dispensing Of Pressurized Material" (hereafter the "Regina Patent");
2. U. S. Pat. No. 3,032,081 issued to La Cotta on May 1, 1962 for "Dispensing Apparatus" hereafter the "La Cotta Patent");
3. U.S. Pat. No. 3,100,065 issued to Gross on Aug. 6, 1963 for "Holder For Pressurized Toothpaste Dispenser" (hereafter the "Gross Patent");
4. U.S. Pat. No. 3,220,613 issued to Palmer et al. on Nov. 30, 1965 for "Remote Control Holder And Actuator" (hereafter the "Palmer Patent");
5. U.S. Pat. No. 4,111,338 issued to Cheng et al. on Sep. 5, 1978 for "Wall Mounted Actuator For Aerosol Can" (hereafter the "Cheng Patent");
6. U.S. Pat. No. 4,789,083 issued to Gutierrez on Dec. 6, 1988 for "Aerosol Operating Device" (hereafter the "Gutierrez Patent"); and
7. U.S. Pat. No. 5,518,051 issued to Wells on May 21, 1996 for "Adaptive Holder Extension Handle And Toothbrush Guide For A Toothpaste Dispenser" (hereafter the "Wells Patent").

The Regina Patent discloses an apparatus for dispensing pressurized material. The device contains a vertically adjustable base and a vertical unit that can be pressed down to dispense material. While accommodating cans of different heights, the device does not easily adapt to accommodate cans with different diameters and is not a device which can be easily mounted to a wall or a shower stall for easy access and use.

The La Cotta Patent discloses an apparatus that is arranged to be mounted fixedly on a wall, and that includes means automatically operable to apply toothpaste to a toothbrush brought into contact with the device.

The Gross Patent discloses a holder for a pressurized toothpaste dispenser. The device includes a handle equipped with a lever which can actuate the can so that its contents are spent. The device does not include means to accommodate cans of different heights or different diameters.

The Palmer Patent discloses a remote control holder and actuator. The container can be supported by a flange which is adjustable in height to accommodate different sized cans. The device also includes a horizontal lever attached by a pivot pin and placed to activate the can. However, the device is cumbersome and the user has to pull on a cord to be able to dispense contents from the can.

The Cheng Patent discloses a wall mountable holder to dispense the contents of an aerosol can.

The Gutierrez Patent discloses an aerosol actuator which employs an outer box-like housing, can be mounted on a door or the like and has an inner space divided by an internal horizontal wall with a wide semicircular notch into which an aerosol container neck fits.

The Wells Patent discloses an adaptive pump-style dispenser including a holder base and at least two converging side rails slanted from top to bottom and connected to the holder base.

While the prior art discloses numerous variations on dispensing units, none of the prior art patents disclose dispensers for dispensing shaving cream or other aerosol dispensed products from cans having different heights and diameters. There is a significant need in the marketplace for such a device which can be easily mounted on a wall or retained on a counter for easy dispensing of the can's contents through the use of only one hand.

SUMMARY OF THE INVENTION

The present invention is a dispenser for dispensing shaving cream or other aerosol dispensed products from cans having different heights and diameters. The dispenser can be easily mounted on a wall or retained on a counter for easy dispensing of the can's contents through the use of only one finger of a user's hand.

The dispenser comprises a circular bottom having an interior cavity and a lip surrounding the cavity which extends upwardly from a side ledge. There is also a vertical post with a hinged transverse member having a downwardly extending peg member. There is a disk insert which can be fitted into the cavity in the bottom of the dispenser. The dispenser can be easily mounted on a wall and in particular on a shower wall so that a person who is shaving in the shower can press down on the transverse member which in turn will cause the peg member to press down on the dispensing unit and dispense shaving cream into the person's hand with the entire motion being done with one hand.

For a conventional standard sized shaving can, the can is fitted into the interior cavity and the overall design of the present invention is such that the downwardly extending peg member comes directly into contact with the dispensing unit of the can so that shaving cream can be dispensed from the can by pressing down on the transverse member so that the peg member presses down on the dispensing unit.

For a shorter can of the same diameter, the sized disk insert is inserted into the cavity to increase the overall height so that the downwardly extending peg member comes in contact with the dispensing unit so that when the transverse member is pressed down, the extending peg member presses on the dispensing unit and shaving cream is dispensed.

In the case of a can with a wider diameter, the can itself does not fit in the opening or cavity, but instead, fits around the opening so that it is secured by an extending lip and the bottom of the can is supported by the transverse ledge on the dispenser and once again, the downwardly extending peg member comes in contact with the dispensing unit so that shaving cream can be dispensed from the dispenser.

The dispensing apparatus also includes a means for holding a safety razor when it is not in use.

It is therefore an object of the present invention to provide a simple and efficient dispensing apparatus to dispense the contents of aerosol cans with one finger and which dispensing apparatus can be easily mounted on a vertical surface such as a shower wall.

It is a further object of the present invention to provide a simple mechanical dispensing apparatus which can accommodate cans of a given diameter and different heights and can also accommodate cans having a shorter height and wider diameter, and which is configured so that each specific can is brought into alignment so that its dispensing nozzle is aligned with the downwardly extending peg member on the transverse member of the dispensing apparatus.

It is another object of the present invention to provide a dispensing apparatus for dispensing shaving cream or other aerosol dispensed products from cans having different heights and diameters wherein the design of the dispensing apparatus can accommodate these different cans with only minor modifications.

It is another object of the present invention to provide a dispensing apparatus for dispensing shaving cream from a can which is able to accommodate different heights and diameters of shaving cream cans, which can also hold a safety razor, and which can be easily mounted on a shower wall so that a user can dispense the shaving cream with one hand while using his other hand to shave with the safety razor.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Figure 1:
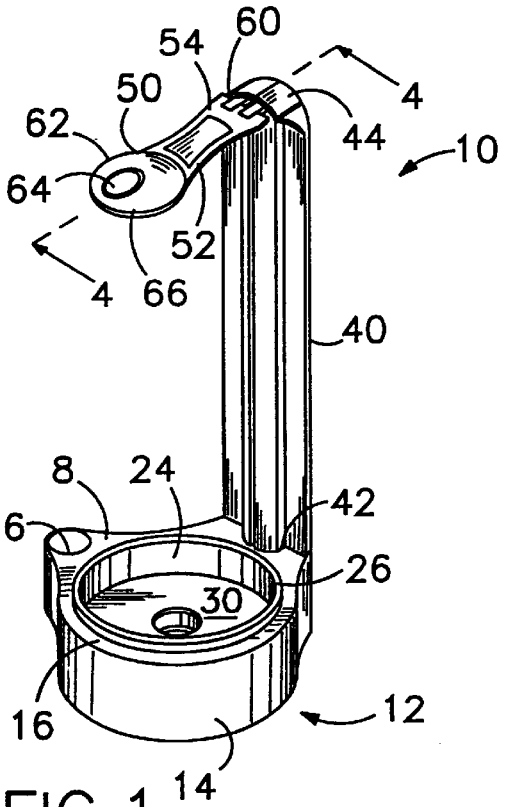
FIG. 1 is a perspective view of the present invention dispensing apparatus.
Figure 2:
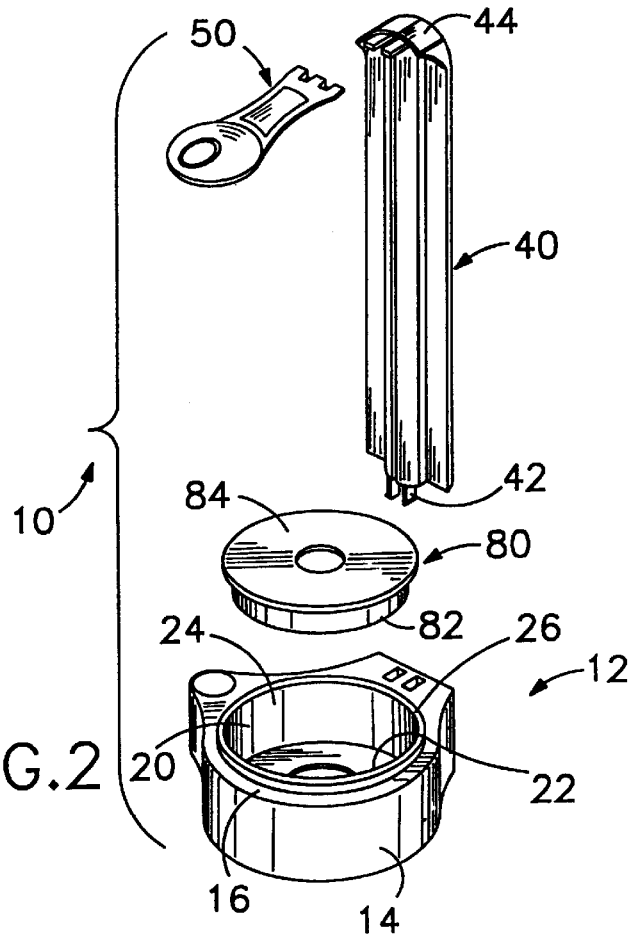
FIG. 2 is an exploded perspective View of the present invention dispensing apparatus.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 5, there is illustrated at 10 the present invention dispensing apparatus. The dispensing apparatus 10 comprises a base 12 and a vertical wall 14 which extends upwardly from the base 12 and terminates at its top with a horizontal ledge 16. The base 12 has a circular opening 20 which extends into a cylindrical cavity 22 which is surrounded by the interior of the vertical wall 14 and which forms a vertical interior sidewall 24. The vertical interior sidewall 24 extends above the horizontal ledge 16 and forms a lip 26. The cavity 22 has a lower base surface 30.

Figure 4:
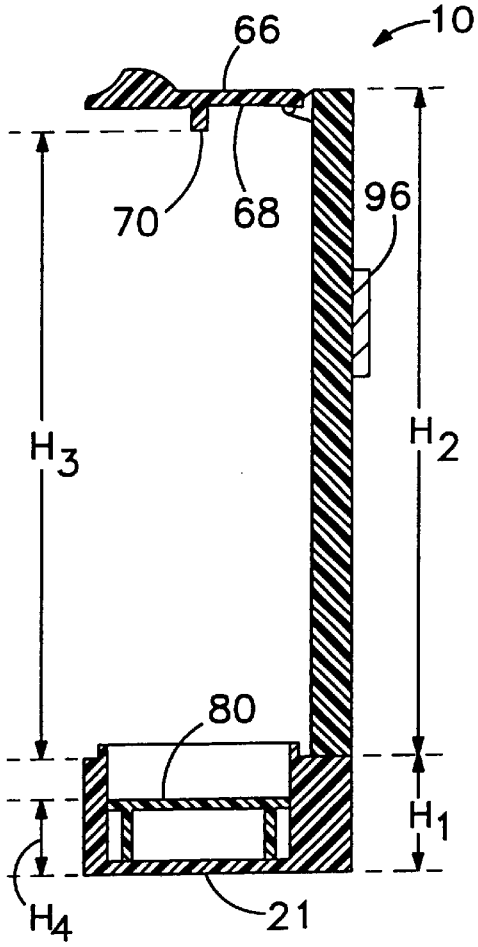
FIG. 4 is a cross-sectional view taken along line 4—4 of FIG. 1.

Attached to the base 12 is a vertical post 40. The vertical post 40 is attached at one end 42 to the base 12, and at its other end 44 is attached to a hinged transverse handle 50. The transverse handle 50 is hingeably attached to the top end 44 of the vertical post 40 by hinge means 60. The transverse handle 50 comprises a horizontal beam member 52 which at one end 54 is attached to or adjacent the top end 44 of the vertical post 40 by hinge means 60 and at its other end terminates in a circular member 62 having a circular depressed portion 64 on the upper surface 66 of the transverse handle 50 to accommodate the end of a user's finger. The hinge means 60 enables the transverse handle 50 to extend in a horizontal direction so that it is approximately parallel to the horizontal ledge 16 and extends above the cylindrical cavity 22. A, lower surface 68 of the transverse handle 50 has a downwardly extending peg 70 attached to it. As best illustrated in FIG. 4, the downwardly extending peg 70 is approximately aligned with the center 21 of cavity 22.

The base 12 also has an outwardly protruding portion 8 located to one side of horizontal ledge 16 which the protruding portion 8 has an opening 6 in which the end of a handle of a safety razor (not shown) can be inserted when the safety razor is not in use.

The dispensing apparatus 10 also further comprises a circular plug insert member 80 which has a diameter that is slightly less that the interior diameter of cavity 22 so that the plug insert member 80 can be inserted into the cylindrical cavity 22. When inserted into the cylindrical cavity 22, the lower surface 82 of the plug insert member 80 sits on lower base surface 30, and the upper surface 84 of the plug insert member 80 now forms the lower interior surface of cylindrical cavity 22.

Figure 6:
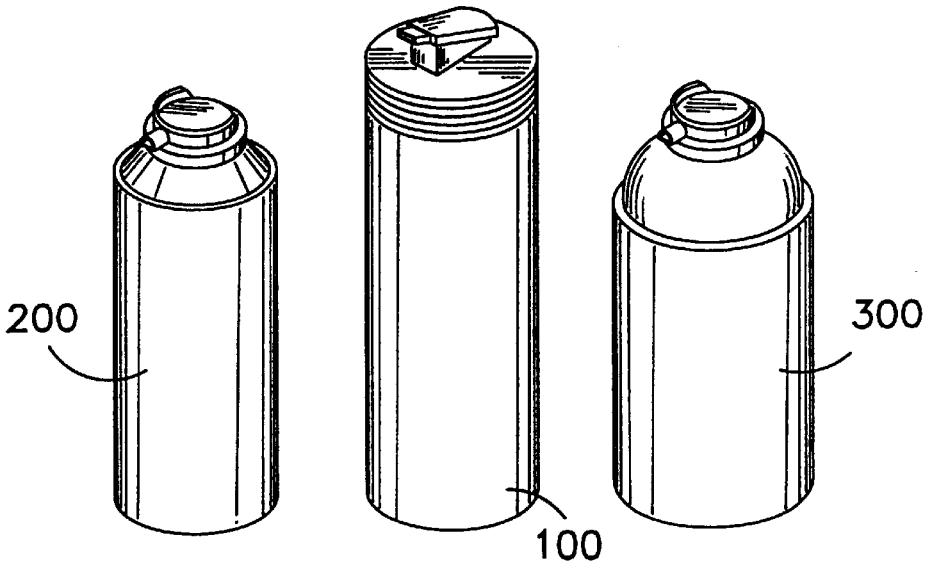
FIG. 6 is a perspective view of the three conventional sizes of shaving cream cans with which the present invention dispensing apparatus can be used.

The intent of the present invention is to provide a dispenser for cans of various heights and diameters so that the cans can be retained by the dispenser and the contents of the cans discharged through the use of one hand. In its most preferred embodiment, the present invention is intended for use with shaving cream cans. Shaving cream cans come in three standard sizes. FIG. 6 is an illustration of the three conventional sizes of shaving cream cans with which the present invention dispensing apparatus can be used. The first size of the shaving cream can 100 which is the tallest is approximately two (2) inches in diameter and approximately seven and one-quarter (7¼) inches tall from the base to the dispensing nozzle. The second size of the shaving cream can 200 is approximately two (2) inches in diameter and six and one-quarter (6¼) inches tall from the base to the dispensing nozzle. The third size of the shaving cream came 300 is approximately two and one-half (2½) inches in diameter and approximately six (6) inches tall from the base to the dispensing nozzle.

Figure 5:
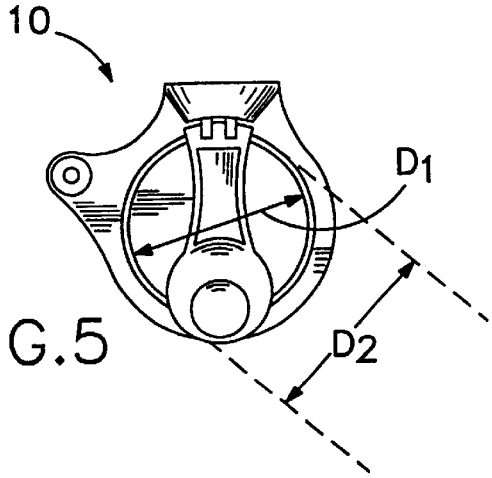
FIG. 5 is a top plan view of the present invention dispensing apparatus.
Figure 3:
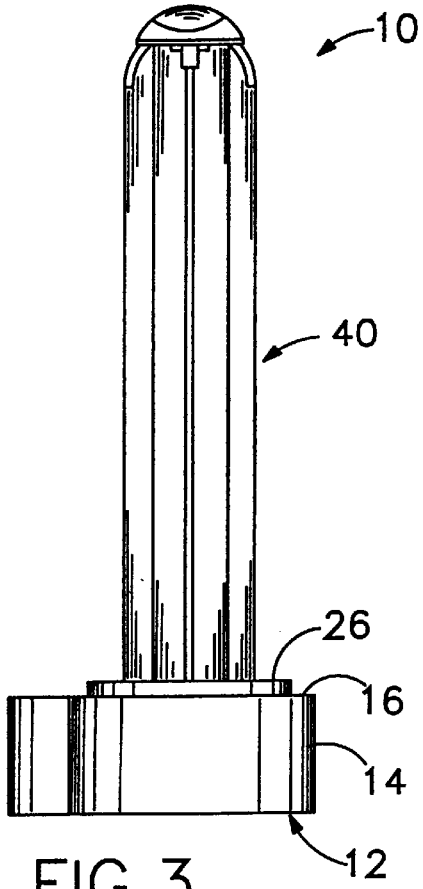
FIG. 3 is a front elevational view in partial cross-section of the present invention dispensing apparatus.

Referring to FIG. 5, the diameter $D_1$ of the cylindrical cavity 22 is approximately 2.110 inches. The diameter $D_2$ of the circular ledge surrounding the cylindrical cavity 22 is approximately 2.385 inches. Referring to FIG. 4, the interior height H, of the cylindrical cavity 22 is approximately 0.99 inches. The height $H_2$ from the horizontal ledge 16 to the lower surface 68 of transverse handle 50 is approximately 6.34 inches. The height $H_3$ from the horizontal ledge 16 to the lower tip of the downwardly extending peg 70 is approximately 6.06 inches. The height $H_4$ of the circular plug member 80 is approximately 0.495 inches.

Figure 7:
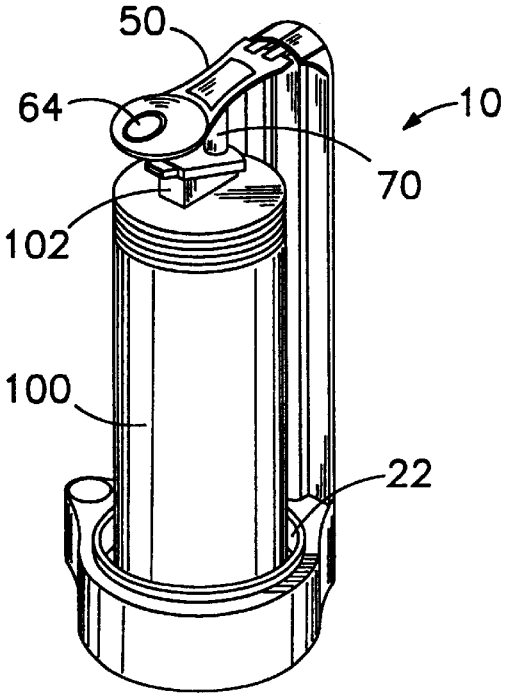
FIG. 7 is a perspective view of the present invention dispensing apparatus in use with the tallest conventional sized shaving cream can.

Referring to FIG. 7, there is illustrated a perspective view of the present invention, dispensing apparatus 10 in use with the tallest conventional sized shaving cream can 100. The tallest sized can is inserted into the cylindrical cavity 22 with no circular plug insert member 80. Based on the dimensions just given, the dispensing nozzle 102 sits just below the lowermost tip of downwardly extending peg 70. When a user desires to dispense shaving cream from can 100, the user places his finger on circular depressed portion 64 of the transverse handle 50 and pushes downwardly. The downwardly extending peg 70 comes in contact with dispensing nozzle 102 and shaving cream is dispensed from the can 100.

Figure 8:
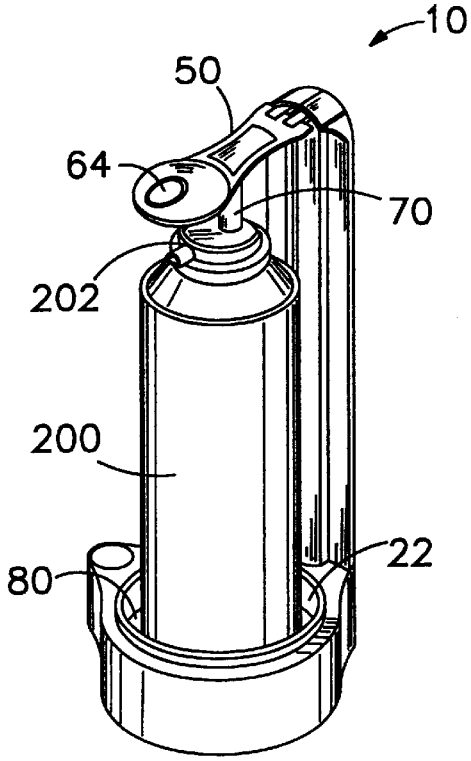
FIG. 8 is a perspective view of the present invention dispensing apparatus in use with a shorter can having the same diameter as the can in FIG. 7.

Referring to FIG. 8, there is illustrated a perspective view of the present invention dispensing apparatus 10 in use with a shorter conventional sized shaving cream can 200 having the same diameter as can 100. In this embodiment, the plug insert member 80 is inserted into cylindrical cavity 22 and the can 200 sits on top of the plug insert member 80 and within cylindrical cavity 22. With this can 200 situated as just described, based on the dimensions just given, the dispensing nozzle 202 sits just below the lowermost tip of the downwardly extending peg 70. When a user desires to dispense shaving cream from can 200, the user places his finger on circular depressed portion 64 of transverse handle 50 and pushes downwardly. The downwardly extending peg 70 comes in contact with dispensing nozzle 202 and shaving cream is dispensed from the can 200.

Figure 9:
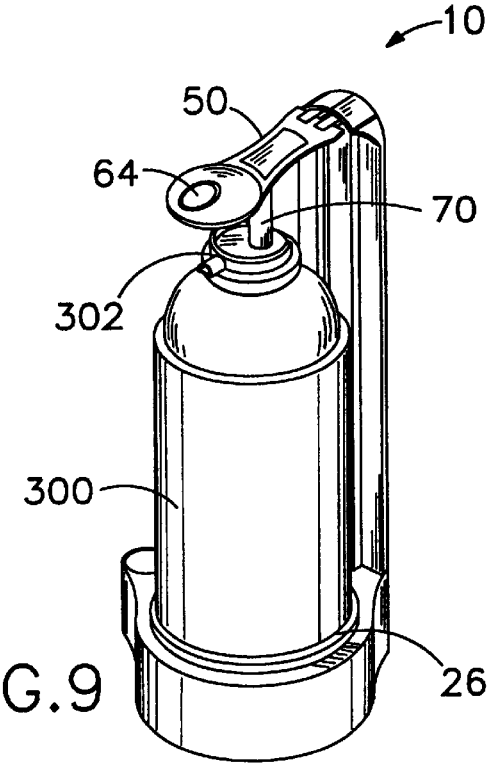
FIG. 9 is a perspective view of the present invention dispensing apparatus in use with a wider and shorter shaving cream can.

Referring to FIG. 9, there is illustrated a perspective view of the present invention dispensing apparatus 10 in use with the widest conventional sized shaving cream can 300. In this embodiment, the can 300 is seated on the horizontal ledge 16 and is secured thereon by lip 26. With this can 300 situated as just described, based on the dimensions just given, the dispensing nozzle 302 sits just below the lowermost tip of downwardly extending peg 70. When a user desires to dispense shaving cream from can 300, the user places his finger on circular depressed portion 64 of transverse handle 50 and pushes downwardly. The downwardly extending peg 70 comes in contact with dispensing nozzle 302 and shaving cream is dispensed from the can 300.

The dispensing apparatus 10 also comprises means 96 for mounting the apparatus to a shower wall. The means can be conventional attachment means.

The dispensing apparatus is preferably made of plastic or comparable waterproof material.

It will be appreciated that the present invention may be used with other cans including aerosol cans for dispensing other types of products and with different sized cans. The dimensions of the dispenser and the plug will have to be adjusted to conform to the diameter and height of the specific can with which the invention will be used.

Defined in detail, the present invention is a dispenser for holding a can of shaving cream and enabling the shaving cream to be dispensed from the can by using only one finger of one hand, the dispenser comprising: (a) a base having an open cylindrical cavity therein, a horizontal ledge surrounding the cylindrical cavity, the cylindrical cavity having an interior sidewall which extends into a lip surrounding the cavity and rising above the horizontal ledge, and a lower base surface within the cavity and forming a bottom of the cavity, the cylindrical cavity being open at its top; (b) a vertical post attached at one end to the base and hingeably attached at its other end to a transverse handle so that the transverse handle extends above and approximately parallel to the cylindrical cavity; (c) a downwardly extending peg attached to the transverse handle and which extends downwardly toward the cylindrical cavity of the base, the peg approximately aligned with the center of the cylindrical cavity; (d) the diameter of the cavity sized for accommodating the diameter of a first can of shaving cream and the height from the lower base surface to the tip of the peg sized for matching the height of the first can of shaving cream from its base to its dispensing nozzle so that the dispensing nozzle lies immediately below the peg; and (e) the diameter of the horizontal ledge sized for accommodating the diameter of a wider can of shaving cream and the height from the horizontal ledge to the tip of the peg sized for matching the height of the wider can of shaving cream from its base to its dispensing nozzle so that the dispensing nozzle lies immediately below the peg; (f) whereby, when the first can of shaving cream is placed in the cylindrical cavity and rests on the base, depressing the transverse handle with one finger enables shaving cream to be dispensed, and when the can is removed, and the wider can is placed on the horizontal ledge and is retained thereon by the lip, depressing the transverse handle with one finger enables shaving cream to be dispensed.

Defined broadly, the present invention is a dispenser for holding an aerosol can and enabling the contents of the can to be dispensed from the can by using only one finger of one hand, the dispenser comprising: (a) a base having an open cylindrical cavity therein, a horizontal ledge surrounding the cylindrical cavity, the cylindrical cavity having an interior sidewall which extends into a lip surrounding the cavity and rising above the horizontal ledge, and a lower base surface within the cavity and forming a bottom of the cavity, the cylindrical cavity being open at its top; (b) a vertical post attached at one end to the base and hingeably attached at its other enid to a transverse handle so that the transverse handle extends above and approximately parallel to the cylindrical cavity; (c) a downwardly extending peg attached to the transverse handle and which extends downwardly toward the cylindrical cavity of the base, the peg approximately aligned with the center of the cylindrical cavity; (d) the diameter of the cavity sized for accommodating the diameter of a first aerosol can and the height from the lower base surface to the tip of the peg sized for matching the height of the first aerosol can from its base to its dispensing nozzle so that the dispensing nozzle lies immediately below the peg; and (e) the diameter of the horizontal ledge sized for accommodating the diameter of a wider aerosol cam and the height from the horizontal ledge to the tip of the peg sized for matching the height of the wider aerosol can from its base to its dispensing nozzle so that the dispensing nozzle lies immediately below the peg; (f) whereby, when the first aerosol can is placed in the cylindrical cavity and rests on the base lower surface, depressing the transverse handle with one finger enables the contents of the aerosol can to be dispensed, and when the can is removed, and the wider can is placed on the horizontal ledge and is retained thereon by the lip, depressing the transverse handle with one finger enables the contents of the can to be dispensed.

Defined more broadly, the present invention is a dispenser for holding an aerosol can and enabling the contents of the can to be dispensed from the can by using only one finger of a user's hand, the dispenser comprising: (a) a base having a cavity therein and a horizontal ledge surrounding the cavity, the cavity having an interior sidewall which extends into a lip surrounding the cavity and rising above the horizontal ledge and a lower base surface within the cavity and forming a bottom of the cavity; (b) a vertical post attached at one end to the base and hingeably attached at its other end to a handle which extends above and approximately parallel to the cavity; (c) a peg attached a lower side of the handle and which extends downwardly toward the cavity of the base, the peg approximately aligned with the center of the cavity; (d) the diameter of the cavity being sized for accommodating the diameter of a first aerosol can and the height from the lower base surface to the tip of the peg being sized for matching the height of the first aerosol can from its base to its dispensing nozzle so that the dispensing nozzle lies immediately below the peg; and (e) the diameter of the horizontal ledge being sized for accommodating the diameter of a wider aerosol can and the height from the horizontal ledge to the tip of the peg being sized for matching the height of the wider aerosol can from its base to its dispensing nozzle so that the dispensing nozzle lies immediately below the peg; (f) whereby, when the first aerosol can is placed in the cavity and rests on the lower base surface, depressing the handle with one finger enables the contents of the first aerosol can to be dispensed, and when the first aerosol can is removed, and the wider aerosol can is placed on the horizontal ledge and is retained thereon by the lip, depressing the handle with one finger enables the contents of the wider aerosol can to be dispensed.

Defined even more broadly, the present invention is a dispenser for holding an aerosol can and enabling the contents of the can to be dispensed from the can by using only one finger of a user's hand, the dispenser comprising: (a) a base having a lower base surface and an interior sidewall extending upwardly from the base surface to form an interior cavity; (b) a vertical post attached at one end to the base and hingeably attached at its other end to a handle which extends above and approximately parallel to the cavity; (c) a peg attached a lower side of the handle and which extends downwardly toward the cavity of the base, the peg approximately aligned with the center of the cavity; and (d) the diameter of the cavity being sized for accommodating the diameter of the aerosol can and the height from the lower base surface to the tip of the peg being sized for matching the height of the aerosol can from its base to its dispensing nozzle so that the dispensing nozzle lies immediately below the peg; (e) whereby, when the first aerosol can is placed in the cavity and rests on the lower base surface, depressing the handle with one finger enables the contents of the first aerosol can to be dispensed.

Further defined even more broadly, the present invention is a dispenser for holding a wider aerosol can and enabling the contents of the can to be dispensed from the can by using only one finger of a user's hand, the dispenser comprising: (a) a base having a horizontal ledge and a lip rising above the horizontal ledge; (b) a vertical post attached at one end to the base and hingeably attached at its other end to a handle which extends above and approximately parallel to the base; (c) a peg attached a lower side of the handle and which extends downwardly toward the base, the peg approximately aligned with the center of the base; and (d) the diameter of the horizontal ledge being sized for accommodating the diameter of the aerosol can and the height from the horizontal ledge to the tip of the peg being sized for matching the height of the aerosol can from its base to its dispensing nozzle so that the dispensing nozzle lies immediately below the peg; (e) whereby the aerosol can is placed on the horizontal ledge and is retained thereon by the lip, depressing the handle with one finger enables the contents of the wider aerosol can to be dispensed.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A dispenser for holding a can of shaving cream and enabling the shaving cream to be dispensed from the can by using only one finger of one hand, the dispenser comprising:

a. a base having an open cylindrical cavity therein, a horizontal ledge surrounding the cylindrical cavity, the cylindrical cavity having an interior sidewall which extends into a lip surrounding the cavity and rising above the horizontal ledge, and a lower base surface within the cavity and forming a bottom of the cavity, the cylindrical cavity being open at its top;

b. a vertical post attached at one end to said base and hingeably attached at its other end to a transverse handle so that the transverse handle extends above and approximately parallel to said cylindrical cavity;

c. a downwardly extending peg attached to said transverse handle and which extends downwardly toward said cylindrical cavity of said base, the peg approximately aligned with the center of said cylindrical cavity;

d. the diameter of said cavity sized for accommodating the diameter of a first can of shaving cream and the height from said lower base surface to the tip of said peg sized for matching the height of the first can of shaving cream from its base to its dispensing nozzle so that the dispensing nozzle lies immediately below said peg; and e. the diameter of said horizontal ledge sized for accommodating the diameter of a wider can of shaving cream and the height from said horizontal ledge to the tip of said peg sized for matching the height of the wider can of shaving cream from its base to its dispensing nozzle so that the dispensing nozzle lies immediately below said peg;

f. whereby, when the first can of shaving cream is placed in said cylindrical cavity and rests on said base, depressing the transverse handle with one finger enables shaving cream to be dispensed, and when the can is removed, and said wider can is placed on said horizontal ledge and is retained thereon by said lip, depressing the transverse handle with one finger enables shaving cream to be dispensed.

2. The dispenser in accordance with claim 1 further comprising a plug member sized to rest within said cylindrical cavity and having a predetermined height, the diameter of said cavity sized for accommodating the diameter of a can of shaving cream and the height from said plug member to the tip of said peg sized for matching the height of the cam of shaving cream from its base to its dispensing nozzle so that the dispensing nozzle lies immediately below said peg.

3. The dispenser in accordance with claim 1, further comprising means to mount the vertical post to a wall of a shower.

4. The dispenser in accordance with claim 1, wherein said base further comprising means to retain a safety razor.

5. The dispenser in accordance with claim 1, wherein said transverse handle further comprises a circular depressed portion at its end remote from the vertical post for accommodating the tip of a finger.

6. A dispenser for holding an aerosol can and enabling the contents of the can to be dispensed from the can by using only one finger of one hand, the dispenser comprising:

a. a base having an open cylindrical cavity therein, a horizontal ledge surrounding the cylindrical cavity, the cylindrical cavity having an interior sidewall which extends into a lip surrounding the cavity and rising above the horizontal ledge, and a lower base surface within the cavity and forming a bottom of the cavity, the cylindrical cavity being open at its top;

b. a vertical post attached at one end to said base and hingeably attached at its other end to a transverse handle so that the transverse handle extends above and approximately parallel to said cylindrical cavity;

c. a downwardly extending peg attached to said transverse handle and which extends downwardly toward said cylindrical cavity of said base, the peg approximately aligned with the center of said cylindrical cavity;

d. the diameter of said cavity sized for accommodating the diameter of a first aerosol can and the height from said lower base surface to the tip of said peg sized for matching the height of the first aerosol can from its base to its dispensing nozzle so that the dispensing nozzle lies immediately below said peg; and e. the diameter of said horizontal ledge sized for accommodating the diameter of a wider aerosol can and the height from said horizontal ledge to the tip of said peg sized for matching the height of the wider aerosol can from its base to its dispensing nozzle so that the dispensing nozzle lies immediately below said peg;

f. whereby, when the first aerosol can is placed in said cylindrical cavity and rests on said base lower surface, depressing the transverse handle with one finger enables the contents of said aerosol can to be dispensed, and when the can is removed, and said wider can is placed on said horizontal ledge and is retained thereon by said lip, depressing the transverse handle with one finger enables the contents of said can to be dispensed.

7. The dispenser in accordance with claim 6, further comprising a plug member sized to rest within said cylindrical cavity and having a predetermined height, the diameter of said cavity sized for accommodating the diameter of an aerosol can and the height from said plug member to the tip of said peg sized for matching the height of the aerosol can from its base to its dispensing nozzle so that the dispensing nozzle lies immediately below said peg.

8. The dispenser in accordance with claim 6, further comprising means to mount the vertical post to a wall.

9. The dispenser in accordance with claim 6, wherein said transverse handle further comprises a circular depressed portion at its end remote from said vertical post for accommodating the tip of a finger.

10. The dispenser in accordance with claim 6, further comprising a plug insert member being sized to rest within said cavity and having a predetermined height, the diameter of said cavity being sized for accommodating the diameter of an aerosol can and the height from said plug member to the tip of said peg being sized for matching the height of the aerosol can from its base to its dispensing nozzle so that the dispensing nozzle lies immediately below said peg.

11. The dispenser in accordance with claim 6, further comprising means to mount said vertical post to a wall.

12. The dispenser in accordance with claim 6, wherein said handle further comprises a depressed portion at its end remote from said vertical post for accommodating the tip of a user's finger.

13. A dispenser for holding an aerosol can and enabling the contents of the can to be dispensed from the can by using only one finger of a user's hand, the dispenser comprising:

a. a base having a cavity therein and a horizontal ledge surrounding the cavity, the cavity having an interior sidewall which extends into a lip surrounding the cavity and rising above the horizontal ledge and a lower base surface within the cavity and forming a bottom of the cavity;

b. a vertical post attached at one end to said base and hingeably attached at its other end to a handle which extends above and approximately parallel to said cavity;

c. a peg attached a lower side of said handle and which extends downwardly toward said cavity of said base, the peg approximately aligned with the center of said cavity;

d. the diameter of said cavity being sized for accommodating the diameter of a first aerosol can and the height from said lower base surface to the tip of said peg being sized for matching the height of the first aerosol can from its base to its dispensing nozzle so that the dispensing nozzle lies immediately below said peg; and e. the diameter of said horizontal ledge being sized for accommodating the diameter of a wider aerosol can and the height from said horizontal ledge to the tip of said peg being sized for matching the height of the wider aerosol can from its base to its dispensing nozzle so that the dispensing nozzle lies immediately below said peg;

f. whereby, when said first aerosol can is placed in said cavity and rests on said lower base surface, depressing said handle with one finger enables the contents of said first aerosol can to be dispensed, and when said first aerosol can is removed, and said wider aerosol can is placed on said horizontal ledge and is retained thereon by said lip, depressing said handle with one finger enables the contents of said wider aerosol can to be dispensed.

14. A dispenser for holding an aerosol can and enabling the contents of the can to be dispensed from the can by using only one finger of a user's hand, the dispenser comprising:

a. a base having a lower base surface and an interior sidewall extending upwardly from the base surface to form an interior cavity;

b. a vertical post attached at one end to said base and hingeably attached at its other end to a handle which extends above and approximately parallel to said cavity;

c. a peg attached a lower side of said handle and which extends downwardly toward said cavity of said base, the peg approximately aligned with the center of said cavity;

d. the diameter of said cavity being sized for accommodating the diameter of said aerosol can and the height from said lower base surface to the tip of said peg being sized for matching the height of said aerosol can from its base to its dispensing nozzle so that the dispensing nozzle lies immediately below said peg; and e. a plug insert being sized to rest within said cavity and having a predetermined height, the diameter of said cavity being sized for accommodating the diameter of a different aerosol can and the height from said plug insert to the tip of said peg being sized for matching the height of the aerosol can from its base to its dispensing nozzle so that the dispensing nozzle lies immediately below said peg;

f. whereby, when said first aerosol can is placed in said cavity and rests on said lower base surface, depressing said handle with one finger enables the contents of said first aerosol can to be dispensed.

15. The dispenser in accordance with claim 14, further comprising means to mount said vertical post to a wall.

16. The dispenser in accordance with claim 14, wherein said handle further comprises a depressed portion at its end remote from said vertical post for accommodating the tip of the finger of said user's hand.

17. The dispenser in accordance with claim 14, wherein said base further comprises a horizontal ledge surrounding said cavity and a lip surrounding said cavity and rising above the horizontal ledge.

18. The dispenser in accordance with claim 17, wherein the diameter of said horizontal ledge being sized for accommodating the diameter of a wider aerosol can and the height from said horizontal ledge to the tip of said peg being sized for matching the height of the wider aerosol can from its base to its dispensing nozzle so that the dispensing nozzle lies immediately below said peg, whereby the wider aerosol can is placed on said horizontal ledge and is retained thereon by said lip, depressing said handle with one finger enables the contents of said wider aerosol can to be dispensed.

19. A dispenser for holding a wider aerosol can and enabling the contents of the can to be dispensed from the can by using only one finger of a user's hand, the dispenser comprising:

a. a base having a horizontal ledge and a lip rising above the horizontal ledge;

b. a vertical post attached at one end to said base and hingeably attached at its other end to a handle which extends above and approximately parallel to said base;

c. a peg attached a lower side of said handle and which extends downwardly toward said base, the peg approximately aligned with the center of said base; and d. the diameter of said horizontal ledge being sized for accommodating the diameter of said aerosol can and the height from said horizontal ledge to the tip of said peg being sized for matching the height of said aerosol can from its base to its dispensing nozzle so that the dispensing nozzle lies immediately below said peg;

e. whereby said aerosol can is placed on said horizontal ledge and is retained thereon by said lip, depressing said handle with one finger enables the contents of said wider aerosol can to be dispensed.

20. The dispenser in accordance with claim 19, further comprising means to mount said vertical post to a wall.

21. The dispenser in accordance with claim 19, wherein said handle further comprises a depressed portion at its end remote from said vertical post for accommodating the tip of the finger of said user's hand.

22. The dispenser in accordance with claim 19, wherein said base further comprises a cavity surrounded by said horizontal ledge and said lip, the cavity having an interior sidewall which extends into said lip and forming a bottom of the cavity.

23. The dispenser in accordance with claim 22, wherein the diameter of said cavity being sized for accommodating the diameter of a narrower aerosol can and the height from said bottom to the tip of said peg being sized for matching the height of the aerosol can from its base to its dispensing nozzle so that the dispensing nozzle lies immediately below said peg, whereby when said narrower aerosol can is placed in said cavity and rests on said bottom, depressing said handle with one finger enables the contents of the narrower aerosol can to be dispensed.

24. The dispenser in accordance with claim 23, further comprising a plug insert being sized to rest within said cavity and having a predetermined height, the diameter of said cavity being sized for accommodating the diameter of a different aerosol can and the height from said plug member to the tip of said peg being sized for matching the height of the aerosol can from its base to its dispensing nozzle so that the dispensing nozzle lies immediately below said peg.

25. A dispenser for holding an aerosol can and enabling the contents of the can to be dispensed from the can by using only one finger of a user's hand, the dispenser comprising:

a. a base having a lower base surface and an interior sidewall extending upwardly from the base surface to form an interior cavity;

b. a vertical post attached at one end to said base and hingeably attached at its other end to a handle which extends above and approximately parallel to said cavity;

c. a peg attached a lower side of said handle and which extends downwardly toward said cavity of said base, the peg approximately aligned with the center of said cavity;

d. the diameter of said cavity being sized for accommodating the diameter of said aerosol can and the height from said lower base surface to the tip of said peg being sized for matching the height of said aerosol can from its base to its dispensing nozzle so that the dispensing nozzle lies immediately below said peg; and e. said base further comprises a horizontal ledge surrounding said cavity and a lip surrounding said cavity and rising above the horizontal ledge;

f. whereby, when said first aerosol can is placed in said cavity and rests on said lower base surface, depressing said handle with one finger enables the contents of said first aerosol can to be dispensed.

26. The dispenser in accordance with claim 25, further comprising a plug insert being sized to rest within said cavity and having a predetermined height, the diameter of said cavity being sized for accommodating the diameter of a different aerosol can and the height from said plug insert to the tip of said peg being sized for matching the height of the aerosol can from its base to its dispensing nozzle so that the dispensing nozzle lies immediately below said peg.

27. The dispenser in accordance with claim 25, further comprising means to mount said vertical post to a wall.

28. The dispenser in accordance with claim 25, wherein said handle further comprises a depressed portion at its end remote from said vertical post for accommodating the tip of the finger of said user's hand.

29. The dispenser in accordance with claim 25, wherein the diameter of said horizontal ledge being sized for accommodating the diameter of a wider aerosol can and the height from said horizontal ledge to the tip of said peg being sized for matching the height of the wider aerosol can from its base to its dispensing nozzle so that the dispensing nozzle lies immediately below said peg, whereby the wider aerosol can is placed on said horizontal ledge and is retained thereon by said lip, depressing said handle with one finger enables the contents of said wider aerosol can to be dispensed.

* * * * *